US005499671A

United States Patent [19]

Owens

[11] Patent Number: 5,499,671

[45] Date of Patent: Mar. 19, 1996

[54] ANTI-FLOAT SYSTEM FOR OPERABLE PARTITIONS

[75] Inventor: N. Douglas Owens, Lynn, Ind.

[73] Assignee: Modernfold, Incorporated, New Castle, Ind.

[21] Appl. No.: 251,903

[22] Filed: Jun. 1, 1994

[51] Int. Cl.[6] ..... E05D 15/26

[52] U.S. Cl. ..... 160/199; 160/188; 16/94 R; 16/95 R

[58] Field of Search ..... 160/199, 206, 160/36, 35, 188; 16/94 R, 95 R; 248/313; 211/89, 65, 66

[56] References Cited

U.S. PATENT DOCUMENTS

| | | | |
|---|---|---|---|
| 1,012,849 | 12/1911 | Hedwall | 160/35 X |
| 1,503,120 | 7/1924 | Drost | 211/68 |
| 1,676,500 | 7/1928 | McGinnis | 160/35 X |
| 2,151,033 | 3/1939 | Jones | 160/35 X |
| 3,494,407 | 10/1970 | Hollands et al. | 160/199 |
| 3,529,651 | 9/1970 | Bender | 160/199 X |
| 5,152,332 | 10/1992 | Siener | 160/206 X |

*Primary Examiner*—Blair M. Johnson
*Attorney, Agent, or Firm*—Baker & Daniels

[57] ABSTRACT

An anti-float system for operable partitions in a movable wall system. The anti-float system includes first and second camming assemblies, each including a trolley camming surface, cooperatively positioned along the operable partition track. Preferably both of the trolley camming surfaces are spring biased to camming positions where they define a passageway through which a portion of the trolley passes when the trolley moves along the track. The passageway is narrower than the width of the trolley portion. When the trolley portion enters the passageway while traveling in the wall extending direction, the trolley portion engages the trolley camming surfaces and forces the surfaces outward from their camming positions against a resistance provided by the biasing springs in order for the trolley to pass. The camming assemblies are also movable from a camming alignment to a retracted alignment when the trolley portion travels in the wall stacking direction through the passageway.

15 Claims, 5 Drawing Sheets

ANTI-FLOAT SYSTEM FOR OPERABLE PARTITIONS

BACKGROUND OF THE INVENTION

This invention pertains to operable partitions movable to partition large rooms into smaller rooms, and, in particular, to an anti-float system for preventing operable partitions from floating out from their stacked arrangement when they are moved between their open, stacked position and their closed, wall forming position.

Operable partitions, also known as movable wall panel systems, find useful application in a variety of venues, such as classrooms, offices, convention centers and hospitals. In these venues, the operable partitions can be utilized to efficiently compartmentalize interior space into a multitude of separate, smaller rooms. One type of movable wall panel system is a continuously-hinged system, in which each operable partition is typically hinged to its adjacent partitions. Continuously-hinged wall panel systems are frequently electrically driven between a stacked position and an extended, wall forming position. When arranged in a proper center stacked position, the operable partitions are folded over one another accordion style with each panel or partition being oriented generally transverse to the overhead track.

One shortcoming of continuously-hinged operable partitions is known as floating and is manifested during the movement of the operable partitions. During partition movement, stacked operable partitions have a tendency to float out, i.e. move along the overhead track away from the location at which they are arranged when properly stacked. For instance, when continuously-hinged operable partitions are extended to form a wall, the leading partition, which is connected to an electric motor via a chain, is pulled from its transverse position at the end of a stacked set of partitions and begins to straighten out. Straightening of the leading partition is normally assisted by guide rails flanking the overhead track which engage the partitions. As the leading partition is pulled off, the remaining stacked partitions, still in a substantially stacked arrangement transverse to the track, often begin to float out in the wall extending direction. This floating is undesirable as these floating stacked partitions can jam at the guide rails and hinder further wall extension. Floating may also be problematic when continuously-hinged operable partitions are stacked. During the stacking process, the trailing partitions which first reach the stacking area are manipulated to break and stack. If these stacked partitions float out, they may interfere with the stacking of subsequent partitions and frustrate the stacking process. In addition, floating can also be a problem with non-level tracks as gravity may cause some partitions to float.

An existing anti-float assembly or apparatus includes two cables, with loops at each end, and a high tension spring interconnecting the cables. The assembly spring is installed in a recess within the top edge of one partition, and each of the cables is guided through mounted diverters and connected to an adjacent partition. This assembly has several shortcomings. For instance, the assembly is difficult to install, must be carefully checked and tightened before installation, and occasionally is not installed for those reasons as well as because of a lack of comprehension by an installer of its function. The separate custom designed components of the assembly may also be relatively expensive. Furthermore, the design of the assembly requires that the cables during operation pass within the space normally occupied by the top sweeps, which extend to the room ceiling, of the partitions. The removal of a portion of the top sweep to accommodate the cables results in a degradation of the acoustical performance of the partition in the field. Thus, it is desirable to provide an anti-float apparatus which prevents floating of the operable partitions without some of these disadvantages.

SUMMARY OF THE INVENTION

In one form thereof, the present invention provides an anti-float apparatus for use with a track and a trolley coupled to an operable partition. The anti-float apparatus includes a first camming assembly positioned along the track. The first camming assembly includes a first trolley camming surface and means for biasing the first trolley camming surface inward to a camming position. The anti-float apparatus also includes a second camming assembly, positioned along the track to cooperate with the first camming assembly, which has a second trolley camming surface. The first trolley camming surface, when disposed in the camming position, and the second trolley camming surface define a passageway therebetween. This passageway is positioned for passage therethrough of a portion of the trolley when the trolley moves along the track. The passageway is narrower than the width of the trolley portion. The first trolley camming surface is forcible outward from the camming position against a resistance provided by the camming surface biasing means when the trolley portion enters the passageway while traveling in the wall extending direction resulting in motion of the trolley in the wall extending direction being resisted.

In another form thereof, the present invention provides an anti-float system for use with a track and a trolley from which is suspended an operable partition. The anti-float system includes a mounting bracket connectable to the track, a first camming assembly, and a second camming assembly. The first camming assembly includes a first camming arm, having a first trolley camming surface, coupled to the mounting bracket and movable relative thereto between a camming alignment and a retracted alignment. The first camming assembly also includes means for biasing the first trolley camming surface inward to a camming position. The second camming assembly includes a second camming arm, coupled to the mounting bracket, having a second trolley camming surface. The first trolley camming surface, when disposed in the camming position, and the second trolley camming surface define a passageway for a portion of the trolley therebetween. This passageway has a narrower width than the width of the trolley portion. The first trolley camming surface is forcible outward from the camming position against a resistance provided by the camming surface biasing means to thereby increase the width of the passageway and enable passage therethrough of the trolley portion when the trolley portion enters the passageway while traveling in the wall extending direction with a force sufficient to overcome the resistance. The resistance is sufficient to prevent passage therethrough of the trolley portion when the trolley portion is traveling in the wall extending direction without sufficient force. The system also includes means for moving the trolley portion in the wall extending direction at the force sufficient to overcome the resistance. The first camming arm is movable from the camming alignment to the retracted alignment when the trolley portion engages the first trolley camming surface while traveling in the wall stacking direction during passage through the passageway.

In still another form thereof, the present invention provides an anti-float system for an operable partition including a track, a trolley coupled to the operable partition and movable along the track in a wall stacking direction and a wall extending direction, a first trolley engaging camming surface, means for biasing the first trolley engaging camming surface to a camming position, a second trolley engaging camming surface, and means for positioning the first trolley engaging camming surface and the second trolley engaging camming surface at a location along the track. The first trolley engaging camming surface, when disposed in the camming position, and the second trolley camming surface define a passageway therebetween. The passageway is arranged for passage therethrough of a portion of the trolley when the trolley moves along the track and is narrower than a width of the trolley portion. The first trolley camming surface is forcible from the camming position against a resistance provided by the camming surface biasing means when the trolley portion enters the passageway while traveling in the wall extending direction, whereby motion of the trolley in the wall extending direction is opposed.

An advantage of the anti-float system of the present invention is that it operates without impairing the acoustical integrity of the operable partitions. Another advantage of the present invention is its ease of installation. Another advantage of the present invention is that the strength of the float resistance applied to the partitions is adjustable. Still another advantage of the present invention is its adaptability for use with different trolley designs.

BRIEF DESCRIPTION OF THE DRAWINGS

The above mentioned and other advantages and objects of this invention, and the manner of attaining them, will become more apparent and the invention itself will be better understood by reference to the following description of an embodiment of the invention taken in conjunction with the accompanying drawings, wherein.

Figure 1:
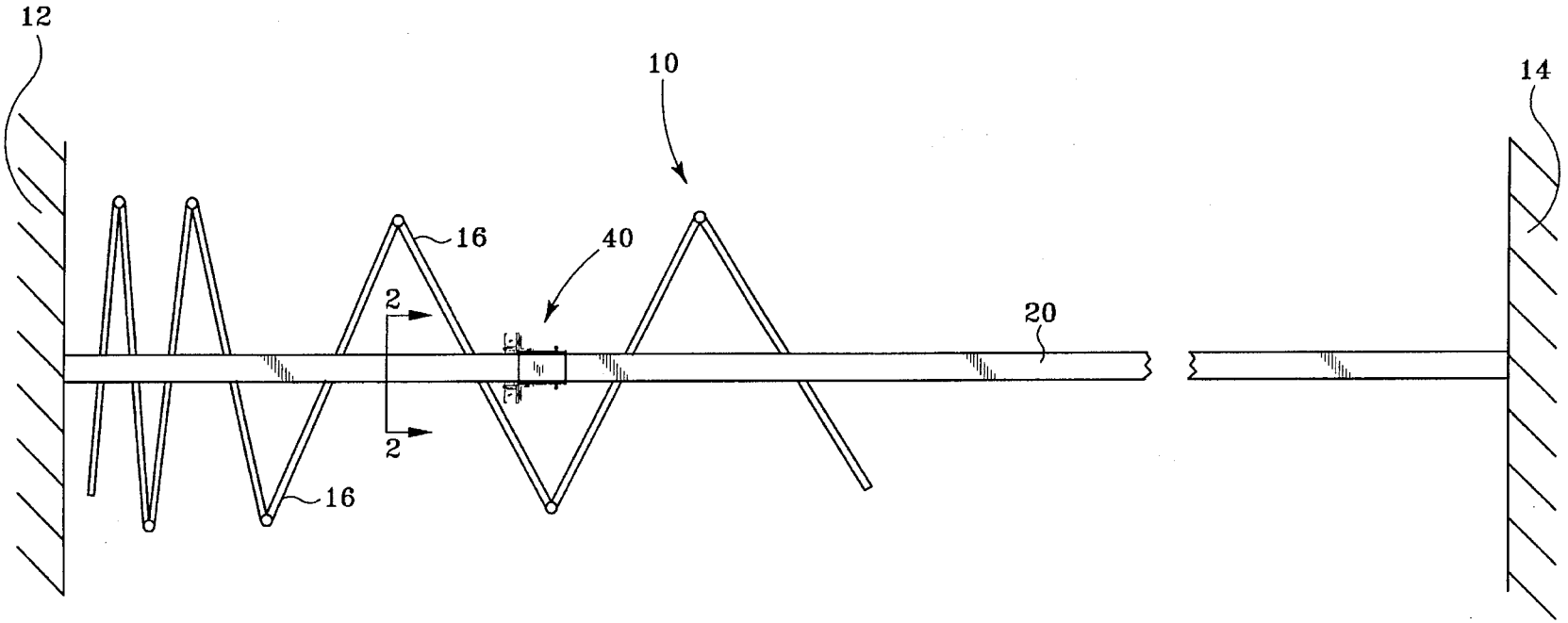
FIG. 1 is a diagrammatic, top view of a room equipped with a movable wall panel system, wherein the anti-float apparatus of the present invention is abstractly represented at an operational position along the length of the overhead trolley track.

Corresponding reference characters indicate corresponding parts throughout the several views. Although the drawings represent an embodiment of the invention, the drawings are not necessarily to scale and certain features may be exaggerated in order to better illustrate and explain the present invention. The exemplification set out herein illustrates one preferred embodiment of the invention, in one form, and such exemplification is not to be construed as limiting the scope of the invention in any manner.

DESCRIPTION OF THE PREFERRED EMBODIMENT

Referring to FIG. 1, there is shown a diagrammatic top view of a moveable wall panel system, generally designated 10, which is used to form a temporary wall between two fixed walls 12, 14. Moveable wall panel system 10 includes a number of continuously-hinged operable partitions 16 which are suspended from trolleys, generally designated 18 (See FIG. 2), guided within overhead track 20. As is conventional, track 20 is mounted in the ceiling of the room and spans walls 12, 14, and trolleys 18 are provided in the first or leading operable partition 16 and every other partition 16 thereafter. Operable partitions 16 are connected to an electric motor (not shown) in a manner known to those of ordinary skill in the art to provide for automatic wall opening and closing. Operable partitions 16 can be moved between an open, stacked position adjacent fixed wall 12 and a closed, extended wall forming position directly under and along the length of track 20. In FIG. 1, operable partitions 16 are illustrated at an intermediate stage of their movement between the stacked and extended positions. It will be appreciated that while explained herein with reference to continuously-hinged operable partitions which are motor driven, the present invention can be advantageously utilized with wall systems using separate partitions and with wall systems which are manually pulled or otherwise moved.

The anti-float apparatus of the present invention, generally designated 40, is abstractly shown in FIG. 1. Anti-float apparatus 40 is particularly designed to prevent partitions 16 which are arranged in their stacked orientation from floating out, or to the right in FIG. 1, when the movable wall system 10 is being extended or stacked. It is desirable both to allow the leading partition 16 to move without passing through and experiencing resistance from apparatus 40 as well as to ensure that the partitions 16 trailing the leading partition are advantageously controlled by apparatus 40. Consequently, anti-float apparatus 40 is preferably positioned along track 20 between the position occupied by the trolley 18 of the leading operable partition 16 and the first trolley 18 to the left in FIG. 1 of the leading operable partition trolley when movable wall system 10 is fully retracted or stacked. It will be appreciated that anti-float apparatus 40 also operates if installed either to the right or left of the preferred installation location.

Figure 2:
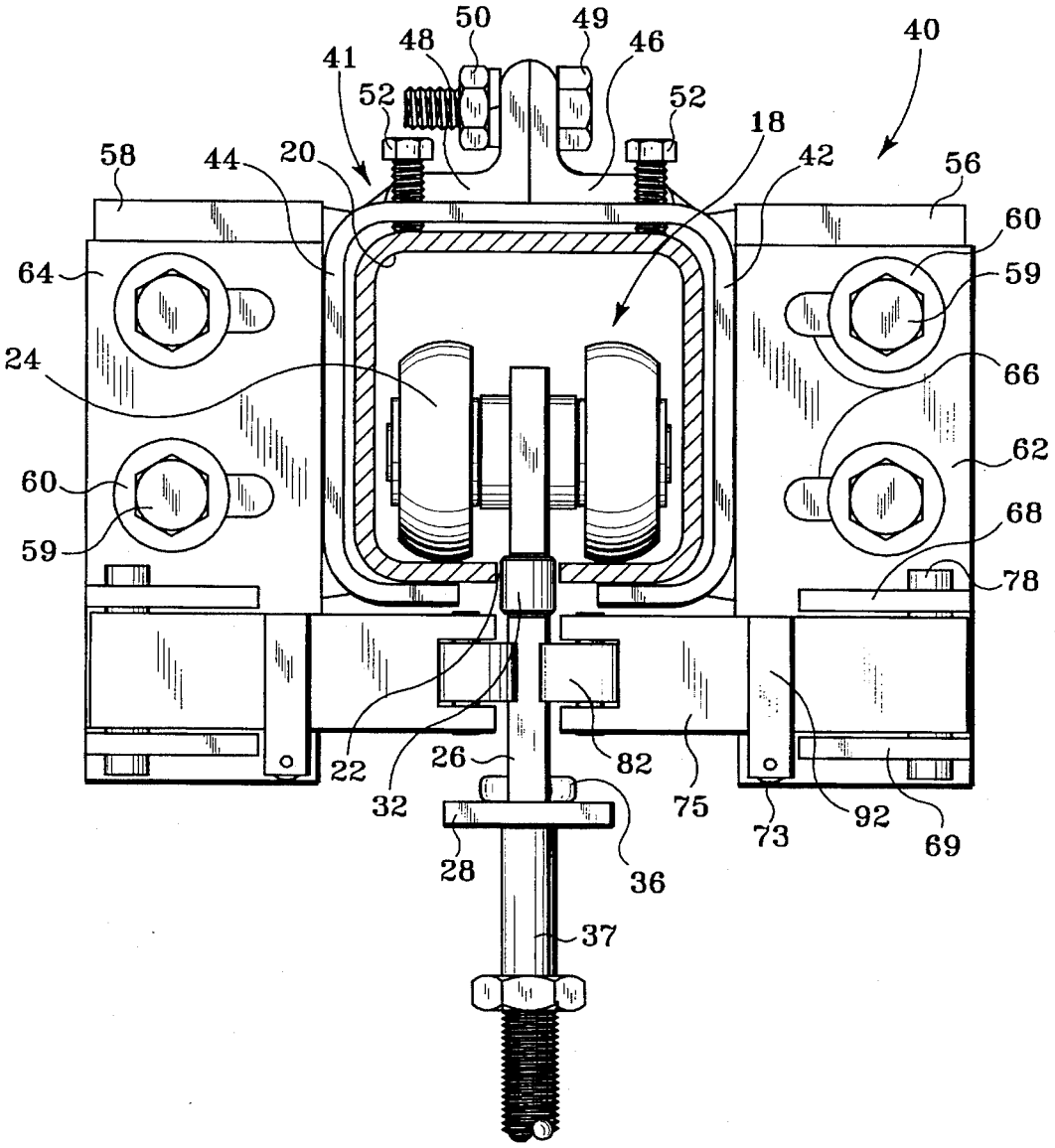
FIG. 2 is a horizontal cross-sectional view, taken along line 2—2 of FIG. 1, showing the anti-float apparatus of the present invention installed on the overhead trolley track, and showing a trolley in the overhead track.
Figure 3:
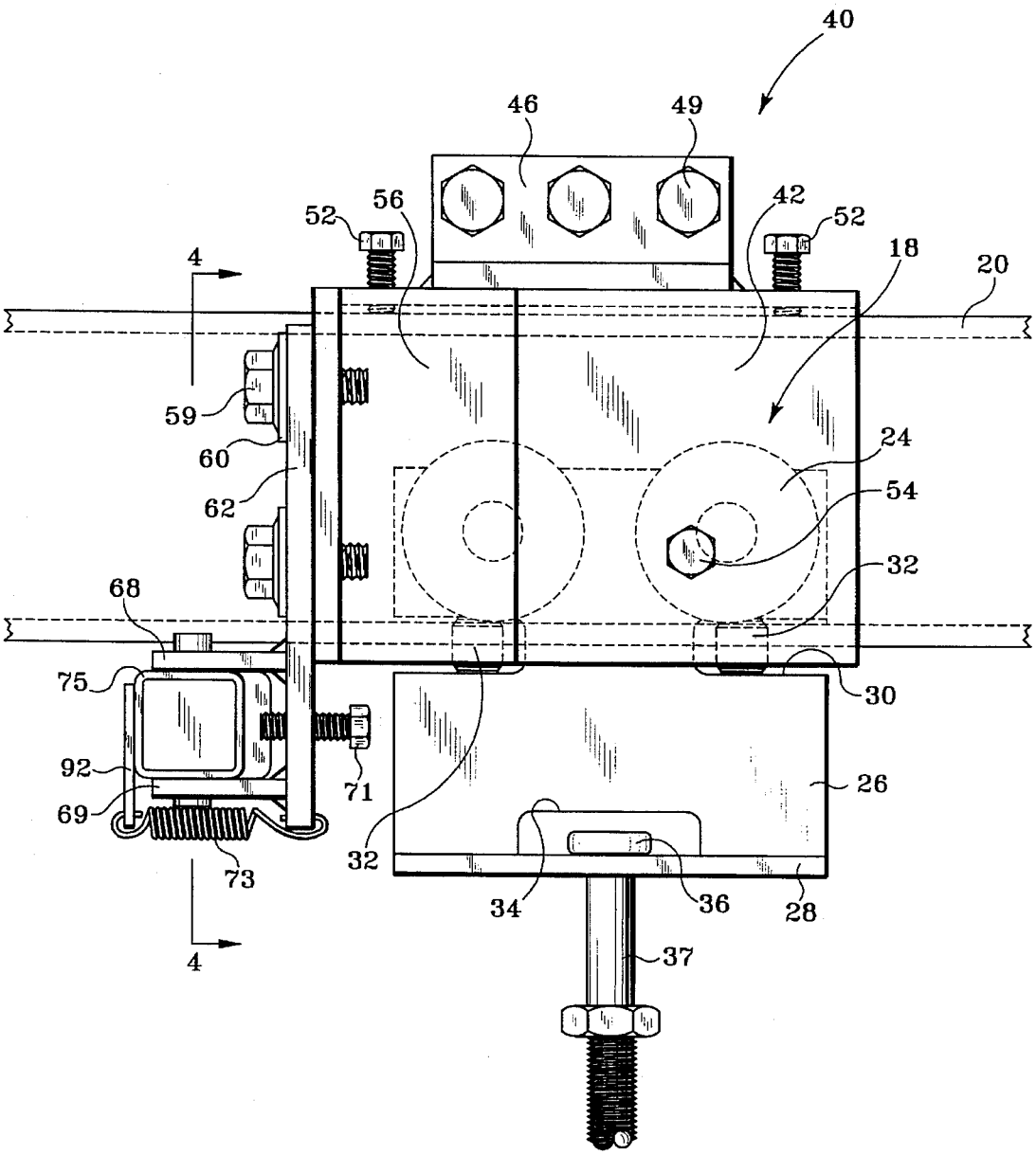
FIG. 3 is a side view of the anti-float apparatus of the present invention, overhead trolley track, and trolley of FIG. 2.

The construction of the preferred anti-float apparatus 40 and a suitable but not required track 20 and trolley 18 for use therewith follows with reference initially to FIGS. 2 and 3. Track 20 is generally C-shaped in vertical cross-section. Trolley 18 includes four wheels 24 which roll along the inside surface of track 20. Wheels 24 are journaled to a vertically extending flat plate 26 of a uniform thickness. Plate 26 extends downward through channel opening 22 in track 20 and has a centered horizontal flange 28 perpendicularly welded to its lower edge. Horizontal notches 30 formed in the side edges of plate 26 are each filled with a roller 32 rotatably mounted on a vertical axle connected to plate 26. Rollers 32 provide trolley 18 with a low friction contact with the edges of track 20 which define channel opening 22. At the lower edge of plate 26, head 36 of threaded trolley shaft 37 fits within aperture 34 of plate 26 and is supported by the top of flange 28. Threaded trolley shaft 37 extends through flange 28 and may project below a room ceiling and be connected to suspended partition 16 in any well known manner.

Still referring to FIGS. 2 and 3, anti-float apparatus 40 is shown installed or mounted on track 20. In view of the following disclosure, it will be appreciated that the illustrated mounting bracket assembly is merely a preferred mounting technique out of the many possible alternatives. In particular, the camming assemblies which during operation engage trolley 18 and oppose or resist its motion could be positioned or stationed at an appropriate location along track 20 by way of a mounting bracket connected to the ceiling or the framework (not shown) from which track 20 is suspended. Alternatively, an integral formation or welded attachment of these camming assemblies with track 20 may be employed, however such an arrangement might hinder the adjustability of apparatus 40 along track 20.

The preferred mounting bracket, generally designated 41, includes two C-shaped bracket halves 42, 44 which are mirror images of one another. Angled coupling flanges 46, 48 have horizontal flange sections which are attached by weld to the upper legs of brackets halves 42, 44 respectively. Bolts 49, which pass through holes in vertical flange sections of flanges 46, 48, are tightened with washers and nuts 50 to rigidly secure the separate bracket halves 42, 44 together. A pair of angled side flanges 56, 58 are attached by weld to the sides of bracket halves 42, 44. The laterally extending flange sections of side flanges 56, 58 each include two threaded bores which receive removable fasteners such as screws 59 and washers 60.

To longitudinally secure mounting bracket 41 at a selected point along the length of track 20, screws 52 inserted in threaded bores in the upper legs of bracket halves 42, 44 tighten down into contact with the top leg of track 20. When screws 52 are tightened, the lower legs of bracket halves 42, 44 are in effect raised into frictional engagement with the lower legs of track 20. Screws 54 inserted in threaded bores in the sides of bracket halves 42, 44 further secure mounting bracket 41 to track 20.

Adjustably connected to the partition stacking side of the laterally extending flange sections of side flanges 56, 58 are adjustment plates 62, 64, which are mirror images of one another. As a result, explanation with reference to adjustment plate 62 in FIG. 4 has equal application to adjustment plate 64. Adjustment plate 62 has two slots 66 formed therethrough which are vertically aligned with the threaded bores which receive screws 59. Two projecting pivot mounting ears 68, 69 are attached by welding to plate 62. As shown in FIG. 3, adjustment plate 62 also includes a threaded bore, which receives stop screw 71, and a hole for attachment of one end of extension spring 73.

Figure 4:
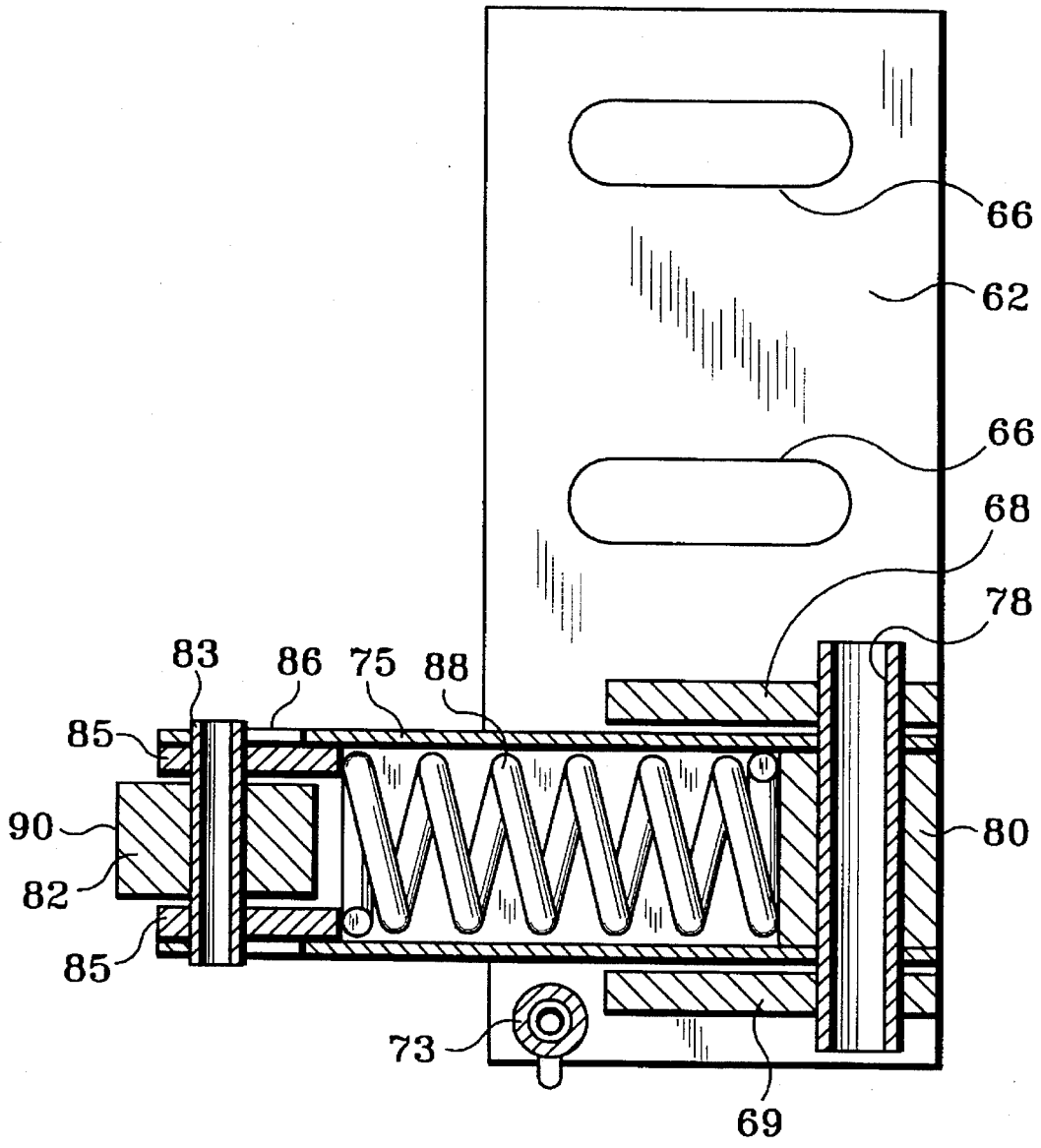
FIG. 4 is a cross-sectional view, taken along line 4—4 of FIG. 3, showing a preferred camming assembly and the attached adjustment plate removed from the remainder of the anti-float apparatus.

Referring now to FIG. 4, a preferred camming assembly is shown in cross-section as taken along line 4—4 of FIG. 3, and is representative of both camming assemblies shown in FIG. 2. The camming assembly includes a camming arm 75, which is constructed from a one-inch square tube and laterally and horizontally extends toward the underside of track 20. Holes aligned in camming arm 75, pivot mounting ears 68, 69, and a bore through a square pivot block 80 inserted within camming arm 75 receive a spring pin 78 or other fastener therethrough which pivotally connects camming arm 75 to adjustment plate 62. Within the end of camming arm 75 opposite pivot block 80 is a cam bearing or roller 82. The inward surface region 90 of roller 82 contacts plate 26 of trolley 18 during movement of trolley 18 during wall movement as described further below. Roller 82 is rotatably supported on spring pin 83, which securely fits within holes provided in a pair of cam mounts 85 above and below roller 82. Opposing ends of spring pin 83 project beyond the surfaces of cam mounts 85 and extend into guide slots 86 (See FIG. 5) on the top and bottom faces of camming arm 75. Compression spring 88 is loaded within camming arm 75 and acts against the outward surface of cam mounts 85 and the inward surface of pivot block 80. While cam mounts 85 are preferably provided to prevent frictional contact between roller 82 and compression spring 88, and pivot block 80 is provided such that compression spring 88 does not directly frictionally contact pivot spring pin 78, both parts are not essential for a proper operation of the invention. In addition, while the biasing of rollers 82 is with a compression spring and internal to camming arms 75, and camming arm 75 and the adjustment plates do not laterally move during biasing, other configurations which achieve the motion resistance of trolley 18 are possible. For example, a biasing device other than a compression spring may be used. Also, camming arm 75, or possibly adjustment plates 62, 64 in their entirety, could be slidably mounted with a spring or other bias mechanism in such as manner so as to serve as the compressing force behind rollers 82.

Figure 5:
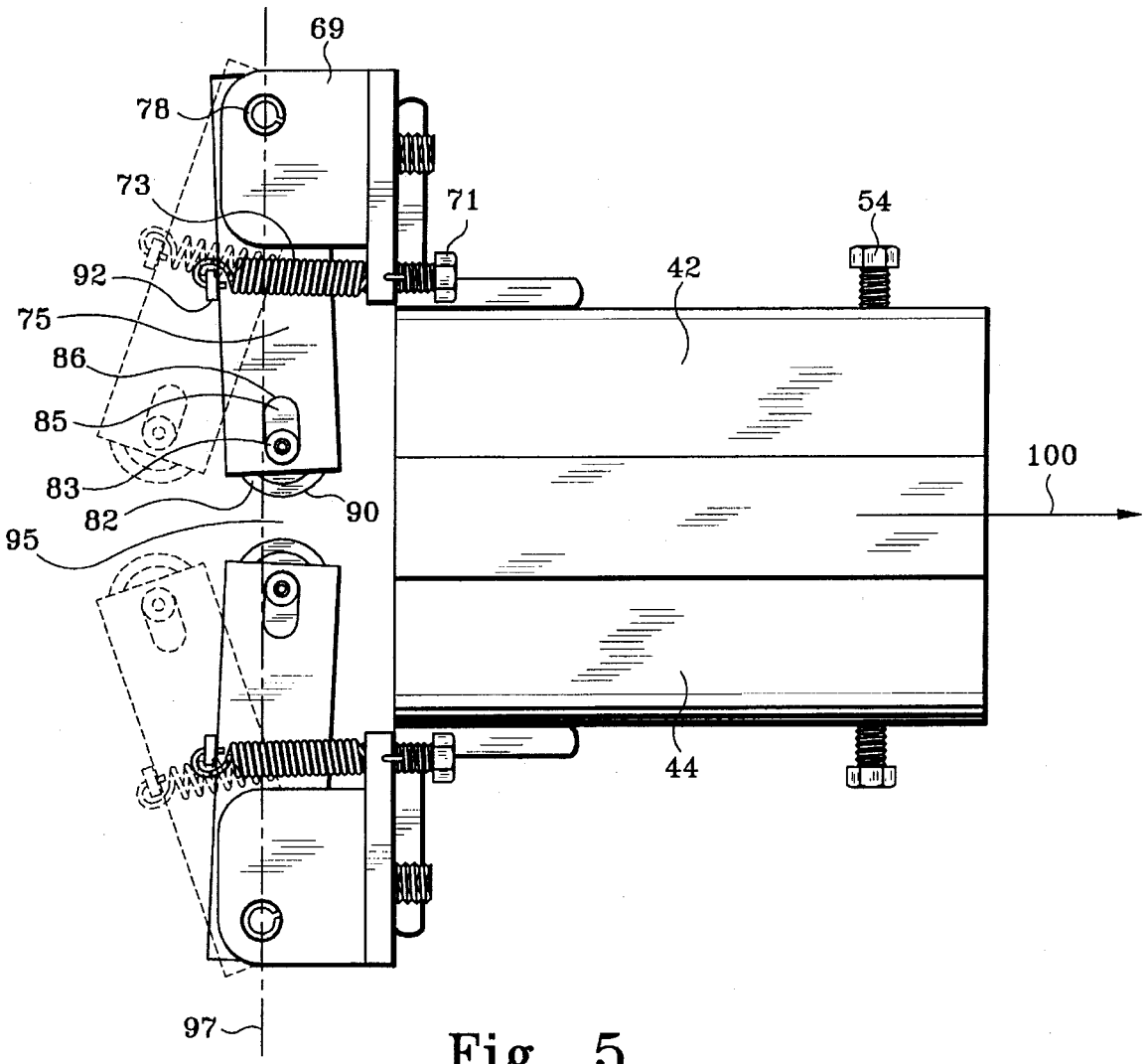
FIG. 5 is a bottom view of the anti-float apparatus of the present invention, wherein the camming arms are also shown in shadow at a swung open, retracted alignment.

Rigidly attached to camming arm 75 is a downwardly extending spring mount 92. As shown in FIG. 5, extension spring 73 spans spring mount 92 and adjustment plate 62. Extension spring 73 biases camming arm 75 toward the wall extending direction, which is the direction of arrow 100. The tip of screw 71 serves as a stop member against which the surface of the camming arm tubing abuts. Rotation of stop screw 71 adjusts its height and thereby adjusts the camming alignment of camming arm 75.

The anti-float apparatus of the present invention will be further understood in view of the following explanation of its installation and operation. Anti-float apparatus 40 is installed by positioning the separate mounting brackets halves 42, 44 along track 20, aligning angled coupling flanges 46, 48, and coupling the brackets together with bolts 49 and nuts 50 as shown. With screws 52, 54 retracted, anti-float apparatus 40 can be slid along track 20, either toward or away from the partition stacking area, into a proper longitudinal position for operation. Screws 52, 54 are then tightened. It will be appreciated that the use of bracket halves, rather than a continuous bracket which slides onto track 20 during track installation, allows anti-float apparatus 40 to be readily removed if desired.

Adjustment plates 62, 64, which may be coupled to bracket halves 42, 44 during their installation, are then secured in a proper position. In particular, while screws 59 are loosened, slots 66 permit adjustment plates 62, 64 to be laterally shifted, i.e. to the left or right in FIG. 2. This shifting allows for accommodation of trolleys with different thickness plates or different designs, such as found in some eight wheel trolleys. When adjustment plates 62, 64 have been positioned such that an appropriately sized gap or passageway 95 (See FIG. 5) for trolley 18 has been formed between the trolley engaging surfaces 90 of rollers 82 at a location centered below track channel opening 22, screws 59 are tightened to restrict further plate motion. Passageway 95, for the illustrated embodiment, is slightly more narrow than the uniform thickness of flat plate 26 at the height of cam rollers 82. It will be appreciated that it is within the scope of the invention to instead form passageway 95 more narrow than a lateral projection or a projecting region of trolley 18. In addition, cam rollers 82 could be positioned in contact with one another when trolley 18 is not passing therebetween and still define passageway 95 as used herein.

When adjustment plates 62, 64 are installed, camming arms 75 are preferably aligned with their rollered ends slightly angled away from the stacking area, or in other words toward the direction in which operable partitions 16 travel when being shifted to a wall forming position. Expressed alternatively, trolley engaging roller surfaces 90, relative to a line connecting the camming arm pivot points or spring pins 78 and which is shown as line 97 in FIG. 5, are away from the stacking area. Larger or smaller angles can be provided by rotating stop screw 71, which effects small adjustments to the width of passageway 95.

The advantageous function of anti-float apparatus 40 occurs when, for example, operable partitions 16 are being moved from a stacked position to form a wall. As partitions 16 arranged in the stacked position move outward in the wall extending direction 100, their trolleys 18 individually encounter anti-float apparatus 40. In particular, the leading edge of trolley plate 26 arrives at passageway 95 and abuts trolley engaging surfaces 90 of rollers 82. It will be appreciated by those of skill in the art that with minor modification, camming arms 75 or their equivalent could readily be arranged to engage a partition supporting trolley in a number of locations to resist its motion. As passageway 95 is more narrow than plate 26, further motion of trolley 18 in wall extending direction 100 is resisted. The presence of stop screws 71 prevents camming arms 75 from pivoting out of the way of trolley 18. In order for trolley 18 to continue through passageway 95, trolley 18 must be pulled or otherwise driven with sufficient force to cause rollers 82 to engage the front edge of plate 26, more particularly ramp up the front edge of plate 26, as plate 26 continues its motion away from the stacking area. During this engagement, trolleys 18 urge rollers 82 laterally outward within camming arms 75 as guided by slots 86 against the biasing forces provided by compression springs 88. The force needed to ramp rollers 82, which is a force needed to be overcome by trolley 18 in order to pass through passageway 95, can be adjusted, for example, by varying the static width of passageway 95 or by using different strength compression springs. As trolley 18 continues in direction 100, rollers 82 roll along and continue to apply a compressive force against the side faces of plate 26. It will be appreciated that if camming arms 75 are angled towards the stacking area, they may have a tendency to slightly splay open toward the stacking area and not adequately apply a compressive force to the trolley sides. In view of this operation, it will be appreciated that for trolleys 18 encountering passageway 95 which are not experiencing pulling or driving forces in the wall extending direction, or in other words trolleys 18 which have been moved into contact with rollers 82 due to floating of their suspended partitions 16, no further movement from the stacking area is permitted by apparatus 40. Only trolleys 18 purposely being forcefully moved in the wall extending direction move with sufficient force to overcome the biasing forces provided by compression springs 88, thereby urging rollers 82 laterally outward, such that trolley 18 can pass through apparatus 40.

When operable partitions 16 are moved from an extended position to a stacked arrangement, anti-float apparatus preferably offers negligible resistance to this motion. In the preferred embodiment shown, as trolleys 18 move toward the stacking area and enter passageway 95, plate 26 again engages by direct contact rollers 82. Instead of rollers 82 needing to be moved outward against compression springs 88, each camming arm 75 pivots toward the stacking area to a retracted alignment as shown in shadow in FIG. 5. When trolley 18 has passed, stretched extension springs 73 return camming arm 75 into contact with screws 71 in preparation for the passage of the next trolley 18.

In addition to swinging camming arms 75 away from trolley 18 by way of engagement therebetween, limited or no resistance to trolley 18 can be provided in alternate ways. For instance, electro-mechanical constructions including solenoid devices could be used to laterally retract or otherwise move camming arms 75, and more particular its trolley engaging surfaces, during wall stacking operations.

While this invention has been described as having a preferred design, the present invention may be further modified within the spirit and scope of this disclosure. For instance, rather than cooperating with trolley 18 directly below track 20, camming arms 75 or their equivalent could be positioned to engage the trolley shaft or perhaps even the trolley portion running inside track 20. This application is therefore intended to cover any variations, uses, or adaptations of the invention using its general principles. Further, this application is intended to cover such departures from the present disclosure as come within known or customary practice in the art to which this invention pertains.

What is claimed is:

1. In combination:

an operable partition;

a track;

a trolley coupled to the operable partition, wherein the trolley is movable along the track in a wall stacking direction and a wall extending direction; and an anti-float apparatus comprising:

a first camming assembly positioned along the track, said first camming assembly comprising a first trolley camming surface and means for biasing said first trolley camming surface inward to a camming position;

a second camming assembly positioned along the track to cooperate with said first camming assembly, said second camming assembly comprising a second trolley camming surface;

wherein said first trolley camming surface, when disposed in said camming position, and said second trolley camming surface define a passageway therebetween, said passageway positioned for passage therethrough of a portion of the trolley when the trolley moves along the track, wherein said passageway is narrower than a width of the trolley portion; and wherein said first trolley camming surface is forcible outward from said camming position against a resistance provided by said camming surface biasing means when the trolley portion enters said passageway while traveling in the wall extending direction, whereby motion of the trolley in the wall extending direction is opposed.

2. The combination of claim 1 wherein said first trolley camming surface comprises a rotatable roller.

3. The combination of claim 1 wherein said second camming assembly further comprises means for biasing said second trolley camming surface inward to a camming position, and wherein said second trolley camming surface when aligned in said camming position defines said passageway.

4. The combination of claim 1 wherein said first camming assembly comprises a camming arm with said first trolley camming surface disposed at one end, wherein said camming arm is pivotable between a camming alignment and a retracted alignment, and wherein said camming arm pivots from said camming alignment to said retracted alignment when the trolley portion enters said passageway while traveling in the wall stacking direction and engages said first trolley camming surface.

5. The combination of claim 4 further comprising means for biasing said pivotable camming arm from said retracted alignment to said camming alignment.

6. The combination of claim 4 further comprising means for adjusting the camming alignment of said pivotable camming arm.

7. The combination of claim 4 further comprising means for mounting said first camming assembly to the track, said mounting means comprising an adjustment plate movable to adjust said camming position of said first trolley camming surface.

8. An anti-float system for an operable partition comprising:

a track;

a trolley for suspending the operable partition, the trolley movable along the track between a wall stacking position and a wall extending position;

a mounting bracket connectable to the track;

a first camming assembly comprising a first camming arm including a first trolley camming surface, wherein said first camming arm is coupled to said mounting bracket and movable relative thereto between a camming alignment and a retracted alignment, said first camming assembly further comprising means for biasing said first trolley camming surface inward to a camming position;

a second camming assembly comprising a second camming arm coupled to said mounting bracket, said second camming arm including a second trolley camming surface;

wherein said first trolley camming surface, when disposed in said camming position, and said second trolley camming surface define a passageway for a portion of the trolley therebetween, said passageway having a narrower width than a width of said trolley portion;

said first trolley camming surface being forcible outward from said camming position against a resistance provided by said camming surface biasing means to thereby increase the width of the passageway and enable passage therethrough of said trolley portion when the trolley portion enters said passageway while traveling in the wall extending direction with a force sufficient to overcome said resistance, said resistance being sufficient to prevent passage therethrough of said trolley portion when the trolley portion is traveling in said wall extending direction without said sufficient force; and means for moving said trolley portion in the wall extending direction at said force sufficient to overcome said resistance;

said first camming arm being movable from said camming alignment to said retracted alignment when said trolley portion engages said first trolley camming surface while traveling in the wall stacking direction during passage through said passageway.

9. The anti-float system of claim 8 wherein said mounting bracket comprises an adjustment plate movable to adjust said camming position of said first trolley camming surface.

10. The anti-float system of claim 8 wherein said second camming assembly further comprises means for biasing said second trolley camming surface inward to a camming position, and wherein said second camming arm is coupled to said mounting bracket and movable relative thereto between a camming alignment and a retracted alignment.

11. The anti-float system of claim 8 wherein said first trolley camming surface comprises a rotatable roller.

12. The anti-float system of claim 8 wherein said second camming assembly further comprises means for biasing said second trolley camming surface inward to a camming position, and wherein said second trolley camming surface when aligned in said camming position defines said passageway.

13. The anti-float system of claim 8 further comprising means for biasing said first camming arm from said retracted alignment to said camming alignment.

14. The anti-float system of claim 8 further comprising means for adjusting the camming alignment of said first camming arm.

15. An anti-float system for an operable partition comprising:

a track;

a trolley movable along said track, said trolley coupled to the operable partition and movable in a wall stacking direction and a wall extending direction;

a first trolley engaging camming surface;

means for biasing said first trolley engaging camming surface to a camming position;

a second trolley engaging camming surface;

means for positioning said first trolley engaging camming surface and said second trolley engaging camming surface at a location along said track;

wherein said first trolley engaging camming surface, when disposed in said camming position, and said second trolley camming surface define a passageway therebetween, said passageway arranged for passage therethrough of a portion of said trolley when said trolley moves along said track, wherein said passageway is narrower than a width of said trolley portion; and wherein said first trolley camming surface is forcible from said camming position against a resistance provided by said camming surface biasing means when said trolley portion enters said passageway while traveling in the wall extending direction, whereby motion of said trolley in the wall extending direction is opposed.

* * * * *